US012672691B2

(12) United States Patent
Manzato et al.

(10) Patent No.: US 12,672,691 B2
(45) Date of Patent: Jul. 7, 2026

(54) LACING SYSTEM FOR SKI BOOTS

(71) Applicant: BOA Technology, Inc., Denver, CO (US)

(72) Inventors: Alessandro Manzato, Mondsee (AT); Zachary Hamilton Jensen, Mondsee (AT); Isabella Oberhauser, Mondsee (AT)

(73) Assignee: BOA Technology, Inc., Denver, CO (US)

( * ) Notice: Subject to any disclaimer, the term of this patent is extended or adjusted under 35 U.S.C. 154(b) by 51 days.

(21) Appl. No.: 18/349,439

(22) Filed: Jul. 10, 2023

(65) Prior Publication Data

US 2024/0008586 A1 Jan. 11, 2024

Related U.S. Application Data

(60) Provisional application No. 63/359,470, filed on Jul. 8, 2022.

(51) Int. Cl.
*A43B 5/04* (2006.01)
*A43C 11/16* (2006.01)

(52) U.S. Cl.
CPC ..... *A43B 5/0447* (2013.01); *A43C 11/165* (2013.01)

(58) Field of Classification Search
CPC ..... A43C 11/165; A43C 11/16; A43B 5/0447; A43B 5/04
USPC ..... 36/50.5, 117.7
See application file for complete search history.

(56) References Cited

U.S. PATENT DOCUMENTS 5,117,567 A * 6/1992 Berger ..... A43C 11/16 36/50.1
5,327,662 A * 7/1994 Hallenbeck ..... A43C 11/00 36/50.1
5,341,583 A * 8/1994 Hallenbeck ..... A43C 11/00 36/50.1

(Continued)

FOREIGN PATENT DOCUMENTS

EP 0589233 A1 * 3/1994 ..... A43C 11/165
IT 20 110 013 A1 8/2012
KR 101982599 B1 * 5/2019 ..... A43C 11/165

OTHER PUBLICATIONS

International Search Report and Written Opinion for PCT/US2023/027227 mailed Jun. 10, 2023, all pages.

(Continued)

*Primary Examiner* — Jameson D Collier
(74) *Attorney, Agent, or Firm* — Kilpatrick Townsend & Stockton LLP; Clark F. Weight

(57) ABSTRACT

An exemplary ski boot as described herein includes an outer shell, at least one guide member, a tensioning mechanism, and a tension member that is operably coupled with the tensioning mechanism so that an operation of the tensioning mechanism adjusts a tension of the tension member. The tensioning mechanism and the at least one guide member are coupled with the outer shell and the at least one guide member is operably coupled with the tension member to route or direct the tension member along a lace path about the ski boot's outer shell. The lace path includes an upper end, a lower end, and a midpoint positioned between the upper end and lower end. The tensioning mechanism is positioned near the midpoint of the lace path.

17 Claims, 4 Drawing Sheets

(56) References Cited

U.S. PATENT DOCUMENTS

| | | | | |
|---|---|---|---|---|
| 5,946,826 | A * | 9/1999 | Merle | A43B 5/04 36/50.5 |
| 6,694,643 | B1 * | 2/2004 | Hsu | A43C 7/00 24/712.1 |
| 9,259,056 | B2 | 2/2016 | Soderberg et al. | |
| 9,700,101 | B2 * | 7/2017 | Lovett | A43C 11/165 |
| 9,770,070 | B2 | 9/2017 | Cotterman et al. | |
| 2004/0159017 | A1 * | 8/2004 | Martin | A43C 1/00 36/50.5 |
| 2006/0021204 | A1 * | 2/2006 | Young | A43C 7/00 24/712.4 |
| 2017/0105489 | A1 * | 4/2017 | Lovett | A43C 1/04 |
| 2017/0202315 | A1 | 7/2017 | Chen | |
| 2021/0196000 | A1 | 7/2021 | Trudel et al. | |
| 2022/0175089 | A1 | 6/2022 | Pollack et al. | |
| 2022/0330650 | A1 * | 10/2022 | Parisotto | A43C 11/1426 |
| 2023/0122485 | A1 * | 4/2023 | Aoki | A43B 3/48 36/50.1 |

OTHER PUBLICATIONS

International Application No. PCT/US2023/027227, International Preliminary Report on Patentability, mailed Jan. 23, 2025, 9 pages. International Bureau of WIPO, Geneva, Switzerland.

* cited by examiner

LACING SYSTEM FOR SKI BOOTS

CROSS-REFERENCE TO RELATED APPLICATIONS

This application claims priority to Provisional U.S. Patent Application No. 63/359,470, filed Jul. 8, 2022, entitled "Lacing System for Ski Boots", the entire disclosure of which is hereby incorporated by reference, for all purposes, as if fully set forth herein.

BACKGROUND

Articles, such as shoes, boots, and other footwear, employ various mechanism that are designed to close and tighten the article. Some articles include materials that are relatively rigid and somewhat difficult to close and tighten. For example, ski boots, such as alpine ski boots, typically have exterior shells that are made of rigid materials, such as various polymers. The exterior shells are often difficult to close about a wearer's leg and foot due to the rigid materials that are employed. It is also often difficult to make the ski boot comfortable to wear due to the rigid materials that are employed. A proper balance between comfort and fit is desired in ski boots but may be difficult to achieve due the use of rigid materials and other design constraints. Conventional closure devices that are employed to close ski boots often tighten the ski boot in relatively large increments, which may add a degree of complexity in achieving a proper balance between fit and comfort. Other articles, such as shoes, may include relatively soft materials that are significantly easier to close. Improved devices and mechanisms for closing various articles are desired.

BRIEF DESCRIPTION

The embodiments described herein relate to articles of footwear, such as ski boots, snowboard boots, work boots, low or high cut shoes, tennis shoes, basketball shoes, and the like. The article of footwear includes a tensioning mechanism, a tension member, and at least one guide member that is configured to route or direct the tension member along a path about the article of footwear. The arrangement of these components, and in particular the routing of the tension member, may provide an improved fit and comfort of the article of footwear about the wearer's foot. The embodiments described herein may be particularly suited for application to ski boot.

According to one aspect, a ski boot includes an upper cuff, a lower shell that is coupled with the upper cuff, and a tensioning mechanism that is coupled with the lower shell. A tension member is operably coupled with the tensioning mechanism so that an operation of the tensioning mechanism adjusts a tension of the tension member. At least one guide member is coupled with the lower shell and is operably coupled with the tension member to route or direct the tension member along a lace path about the lower shell. The lace path includes an upper end that is positioned near the upper cuff, a lower end that is positioned near a toe region of the ski boot, and a midpoint that is positioned between the upper end and lower end. The tensioning mechanism is positioned near the midpoint of the lace path so that a first portion of the tension member is routed above the tensioning mechanism on the upper end of the lace path and a second portion of the tension member is routed below the tensioning mechanism on the lower end of the lace path.

The ski boot's lower shell may include a first flap or panel and a second flap or panel that overlaps the first flap or panel to form a seam. The tensioning mechanism may be positioned on the first flap or panel or the second flap or panel, and the lace path may cross the seam one or more times. In such instances, the at least one guide member may include a first guide member and a second guide member that are each coupled with the second flap or panel. A distal end of the first guide member may extend laterally across the second flap or panel to the seam and a distal end of the second guide member may extend laterally across the second flap or panel and across the seam. In some instances, the tensioning mechanism may be coupled with the first flap or panel and the at least one guide member may include a first guide member and a second guide member that are each coupled with the first flap or panel. The first guide member may be positioned on the upper end of the lace path above the tensioning mechanism, the second guide member may be positioned on the lower end of the lace path below the tensioning mechanism, and the first guide member and the second guide member may be the only guide members that are coupled with or positioned on the first flap or panel.

In some instances, a proximal end of the tension member may be coupled with the tensioning mechanism so that the tensioning mechanism only tensions a single end of the tension member. In other instances, opposing ends of the tension member may be coupled with the tensioning mechanism so that the tensioning mechanism tensions both ends of the tension member.

The tension member may be routed directly from the tensioning mechanism to a pair of guide members that are positioned on an upper most end of the lace path. In such instances, or in any other instance, the tension member may cross itself once, or only a single time, along the lace path. The tensioning mechanism may be configured to enable both an incremental release in tension of the tension member and a full release of tension in the tension member.

According to another aspect, a ski boot includes an outer shell, a tensioning mechanism that is coupled with the outer shell, a tension member that is operably coupled with the tensioning mechanism so that an operation of the tensioning mechanism adjusts a tension of the tension member, and at least one guide member that is coupled with the outer shell and operably coupled with the tension member to route or direct the tension member along a lace path about the outer shell. The lace path may include an upper end, a lower end, and a midpoint positioned between the upper end and lower end. The tensioning mechanism may be positioned near the midpoint of the lace path.

The tension member may be routed directly from the tensioning mechanism to a pair of guide members that are positioned on an upper most end of the lace path and/or the tension member may only cross itself once along the lace path. The outer shell may include a first flap or panel and a second flap or panel that overlaps the first flap or panel to form a seam. In such instances, the tensioning mechanism may be positioned on the first flap or panel or the second flap or panel and the lace path may cross the seam one or more times. The at least one guide member may include a first guide member and a second guide member that are each coupled with the second flap or panel. In such instances, a distal end of the first guide member may extend laterally across the second flap or panel to the seam and a distal end of the second guide member may extend laterally across the second flap or panel and across the seam.

In some instances, the tensioning mechanism may be coupled with the first flap or panel and the at least one guide member may include a first guide member and a second guide member that are coupled with the first flap or panel. The first guide member may be positioned on the upper end of the lace path above the tensioning mechanism and the second guide member may be positioned on the lower end of the lace path below the tensioning mechanism. The first guide member and the second guide member may be the only guide members that are coupled with, or positioned on, the first flap or panel. A proximal end of the tension member may be coupled with the tensioning mechanism so that the tensioning mechanism tensions a single end of the tension member.

According to another aspect, an article of footwear includes an outer material that defines an outer layer of the article of footwear and a tensioning mechanism that is coupled with the outer material. A tension member is operably coupled with the tensioning mechanism so that an operation of the tensioning mechanism adjusts a tension of the tension member. At least one guide member is coupled with the outer material and is operably coupled with the tension member to route or direct the tension member along a lace path about the article of footwear. The lace path includes an upper end, a lower end, and a midpoint positioned between the upper end and lower end and the tensioning mechanism is positioned near the midpoint of the lace path.

The tension member is routed directly from the tensioning mechanism to a pair of guide members that are positioned on an upper most end of the lace path. The tension member only crosses itself once along the lace path. A proximal end of the tension member is coupled with the tensioning mechanism so that the tensioning mechanism tensions a single end of the tension member.

BRIEF DESCRIPTION OF THE DRAWINGS

The present invention is described in conjunction with the appended figures.

Figure 1A:
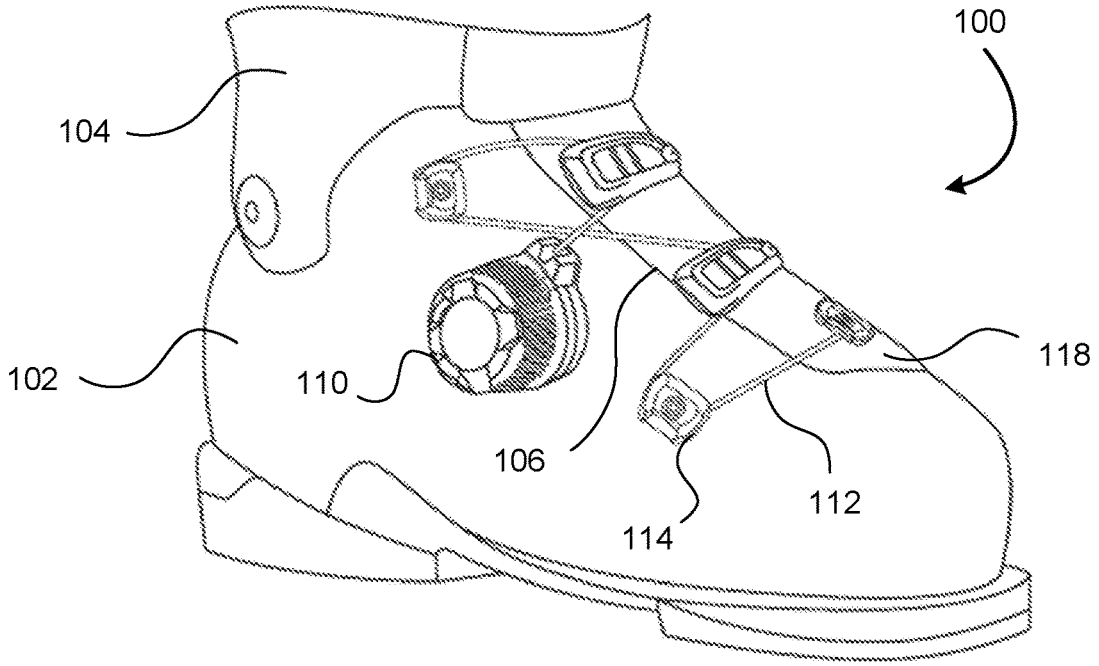
FIGS. 1*a-b* illustrate a first configuration of a lacing system for a ski boot.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The embodiments herein describe novel lacing systems that are particularly useful for ski boot and other articles of footwear. The lacing systems may be particularly suited to close articles of footwear that include or employ rigid or semi-rigid components, such as outer shells or materials that are formed of plastic. The lacing systems may be useful to close and tighten these components about a wearer's foot. While the application describes the lacing systems being used for ski boots, it should be readily understood that the lacing systems may be similarly applicable to other articles of footwear, such as boots, snowboard boots, work boots, low or high cut shoes, tennis shoes, basketball shoes, and the like. For ease in describing the various embodiments, the description will refer to the lacing systems being used on ski boots.

The lacing system includes a tightening mechanism and a lace or tension member. The tension member is a cord, rope, or other structure that is designed to be tensioned to close and tighten the ski boot. The tightening mechanism is typically a reel based closure device that is configured to tension the tension member via operation of the reel based closure device. The tension member is guided about the ski boot via one or more guide members, which may be rigid components that are made of plastic or other materials, or which may be flexible and soft components that are made of fabric materials.

The reel based device includes a knob or dial that may be grasped and rotated by the wearer. The knob or dial is commonly coupled with a spool around which the tension member is wound in response to rotation of the knob or dial in a tightening direction. Rotation of the tension member around the spool tensions the tension member, which tightens the ski boot about the wearer's foot by constricting the shell and any internal components (i.e., a liner, etc.) about the wearer's foot. Exemplary reel based devices are further described in U.S. patent application Ser. No. 14/297,047 filed Jun. 5, 2017, and entitled "Integrated Closure Device Components and Methods", and in U.S. Pat. No. 9,259,056, filed Jun. 21, 2013, and entitled "Reel Based Lacing System", the entire disclosures of which are incorporated by reference herein.

The reel based device replaces traditional buckles and/or other tightening systems that are currently used on ski boots to tighten the ski boot about the wearer's foot. Reel based devices are significantly easier to operate than traditional buckles and/or other tightening systems. As such, wearer's may greatly prefer to use the reel based devices in tightening a ski boot. In addition, reel based devices offer incremental degrees of tightening and loosening of the ski boot in comparison with traditional buckles and/or other tightening systems. For example, traditional buckles and/or other tightening systems often include a limited number of tightening segments (e.g., teeth, steps, racks, and the like) that are used in tightening the ski boot. For example, traditional buckles often employ 5 to 10 teeth on a rack within which an engagement pin is positioned to tighten the ski boot. The engagement pin is moved proximally or distally about the rack and positioned within a proximal or distal tooth in order to increase or decrease the tightness of the ski boot about the foot. The limited number of tightening segments (e.g., teeth) results in the ski boot being tightened or loosened by greater segments or degrees and thus, it may be difficult to achieve a desired and comfortable fit.

In contrast, reel based devices are capable of tightening and/or loosening the ski boot by significantly smaller incremental segments, amounts, or degrees. For example, if a minor increase in tightness is desired, the knob of the reel based device may be rotated by a quarter turn or even an eighth of a turn to slightly increase the tension in the tension member. The slight increase in the tension member's tension normally results in a slight increase in the tightness or constriction of the ski boot about the wearer's foot. This incremental adjustment of the ski boot's tightness allows a desired and comfortable fit of the ski boot about the foot to be more easily achieved.

The tension member is typically routed about an opening of the ski boot. For example, in ski boots, the lower shell is often formed with a pair of panels or flaps (e.g., a medial flap and a lateral flap) in which one of the flaps (e.g., the medial flap) overlaps the other flap (e.g., the lateral flap). The overlapping flaps forms a seam. The tension member is commonly routed between opposing sides of the ski boot's lower shell so that the tension member crosses the seam one or more times. In this manner, a portion of the tension member is positioned on a first side of the seam while another portion of the tension member is positioned on a second side of the seam. Tensioning of the tension member causes the overlapping flaps to slide laterally relative to one another, which closes the lower shell about the wearer's foot.

The tension member is guided between the opposing sides of the ski boot via guides that are attached to the lower shell. The tension member forms a path about the lower shell as it is guided via the plurality of guides. The configuration and/or orientation of the tension member path may aid in applying a desired tension force to the lower shell. Accordingly, the tension member path may be shaped to achieve a desired fit of the ski boot about the wearer's foot. FIGS. 1*a*-4*b* illustrate various lace path configurations that may be employed to close and tighten a ski boot's lower shell about the wearer's foot.

Figure 1B:
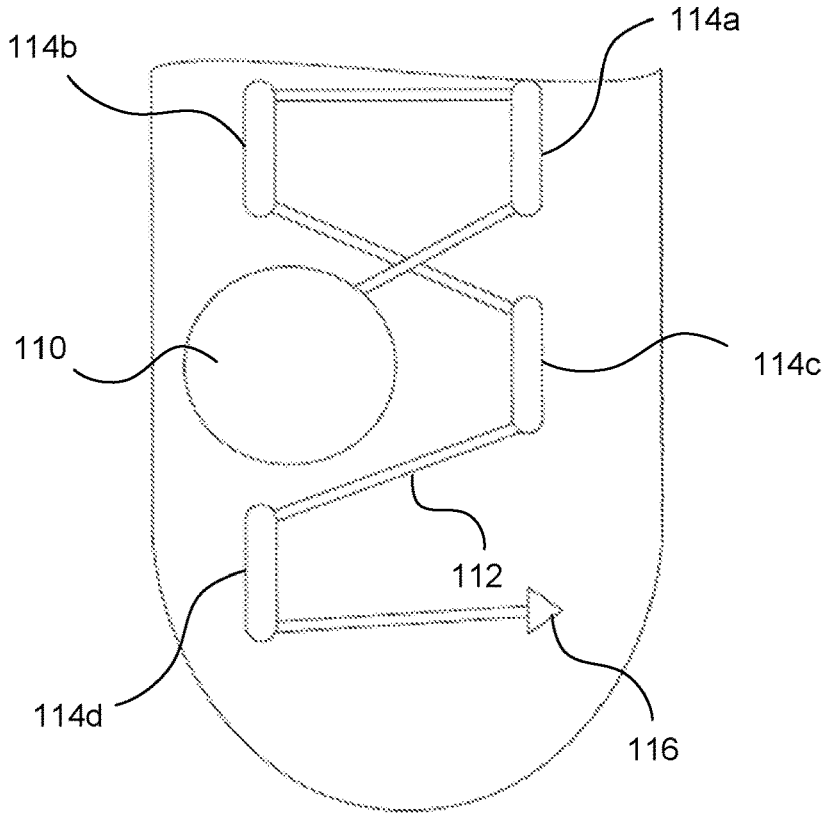

Referring to FIGS. 1*a*-*b*, illustrated is a ski boot 100 that includes a lower shell 102 and upper cuff 104 that is coupled with the lower shell as is known in the art. A lacing system is attached to the lower shell 102. The lacing system includes, or consists of, a reel based device 110, a tension member 112, and one or more guides 114. The lacing system is configured and oriented to increase ankle retention and improve heel hold within the ski boot 100. The increased ankle retention and heel hold can increase skiing confidence and improve power transfer between the wearer and ski boot 100.

The increased ankle retention and improved heel hold are achieved, in part, by the novel routing of the tension member 112 about the lower shell 102. The tension member 112 is routed so that it crosses a seam 106 that is defined by overlapping flap 118, which in the illustrated embodiment is the medial flap of the lower shell 102. The routing of the tension member 112 is more evident in FIG. 1B, which is a simple representation of the lacing system and lower shell 102. As illustrated, the reel based device 110 is positioned on a first side of the lower shell 102 (e.g., on the lateral flap). A proximal end of the tension member 112 is operably coupled with the reel based device 110 so that operating the reel based device 110 (i.e., rotating the knob) winds the tension member 112 about the spool and thereby tensions the tension member 112. Tensioning of the tension member 112 pulls the overlapping flap 118 over the underlying flap, which tightens the lower shell 102 about the wearer's foot. In the illustrated embodiments, the reel based device 110 pulls on, or tensions, a single end of the tension member 112. However, the tension member 112 may be routed about the ski boot 100 so that the reel based device 110 tensions both ends of the tension member 112.

The tension member is routed from the reel based device 110 diagonally to a first guide 114*a* that is positioned longitudinally above the reel based device 110; or stated differently, the first guide 114*a* is positioned closer to the upper cuff 104 than the reel based device 110. The tension member 112 is routed from the first guide 114*a* to a second guide 114*b* that is also positioned longitudinally above the reel based device 110. The tension member 112 is routed from the second guide 114*b* to a third guide 114*c* that is positioned across the seam 106 from the reel based device 110. The tension member 112 crosses itself as it is routed between the first guide 114*a*, the second guide 114*b*, and the third guide 114*c*. The tension member is routed from the third guide 114*c* to a fourth guide 114*d* that is positioned longitudinally below the reel based device 110 and typically on the same side of the lower shell 102 as the reel based device 110. The tension member 112 is routed from the fourth guide 114*d* to a termination guide 116 that is positioned longitudinally below the reel based device 110 and across the seam 106 from the reel based device 110.

In the illustrated embodiment, the reel based device 110 is positioned near a midpoint or center of the lace path defined by the tension member 112. In this configuration, the ski boot 100 includes a guide set, or one or more guides, that are positioned longitudinally above the reel based device 110 and one or more guides that are positioned longitudinally below the reel based device 110. Because the tension member 112 is routed "upward" directly from the reel based device 110 to the guide set (guides 114*a* & 114*b*), the guide set receives the greatest closure force. The guide set (guides 114*a* & 114*b*) is positioned close to the cuff, often as close as possible, so that the closure force closes and tightens the ski boot 100 about the wearer's ankle. The guides 114*a* & 114*b* work cooperatively to close and tighten the ski boot 100 about the wearer's ankle. The lower guide 114*d* receives the least closure force and is positioned to close the ski boot 100 about the forefoot.

The tension member 112 includes a single crossing in the illustrated embodiment. As further described in the '407 application and the '056 patent incorporated herein, the reel based device 110 may be a full release type system or a system that enables full release and incremental release of the tension member 112. The guides 114 may be a rigid guide, a semi-rigid guide, a flexible or rigid strap, and the like, or any combination thereof. Similarly, the guides 114 may be shorter guides or longer guides, or any combination thereof. Exemplary guides are further described in U.S. patent application Ser. No. 17/542,130, filed Dec. 3, 2021, and entitled "Reel Based Closure Device", the entire disclosure of which is incorporated by reference herein. As illustrated in FIG. 1*a*, a distal end of one or more of the guides (typically a longer guide) may extend to the seam 106 or across the seam 106. Specifically, in the illustrated embodiment, the distal end of the first guide 114*a* extends to the seam 106 while the distal end of the third guide 114*c* extends across the seam 106.

Figure 2A:
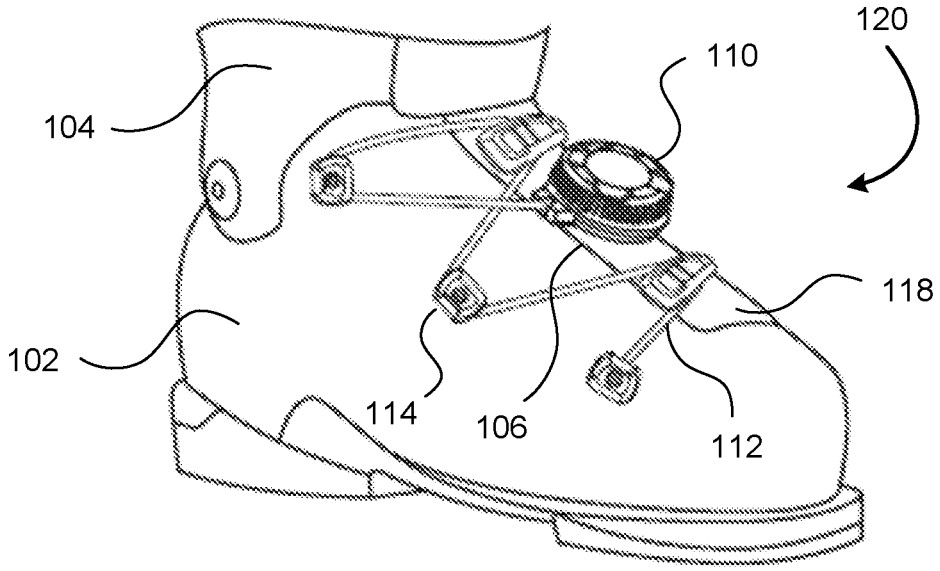
FIGS. 2*a-b* illustrate a second configuration of a lacing system for a ski boot.
Figure 2B:
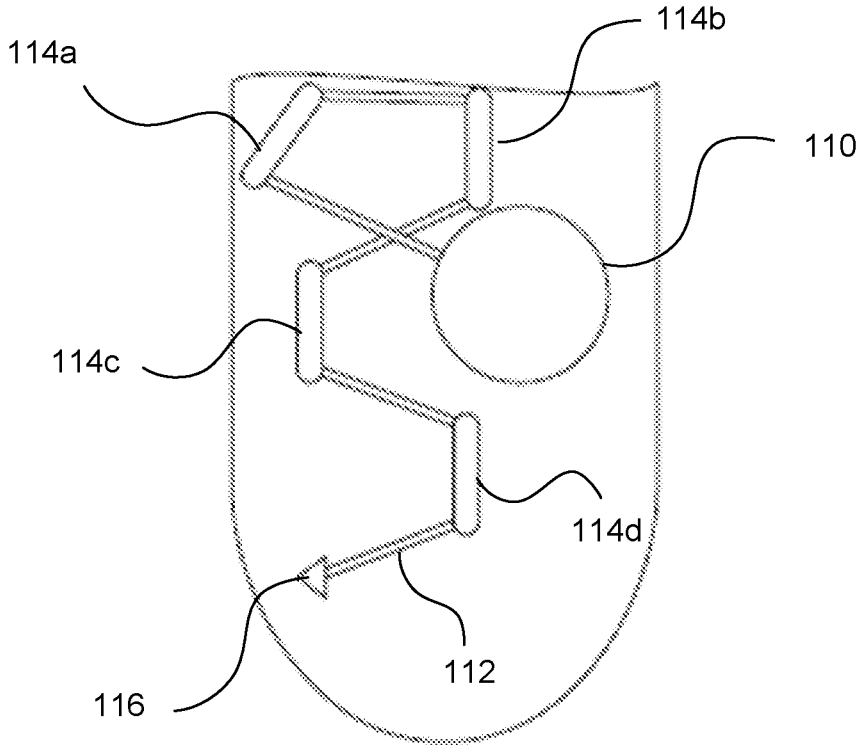

Referring to FIGS. 2*a*-*b*, illustrated is another ski boot 120 that includes a lower shell 102 and upper cuff 104 that is coupled with the lower shell as is known in the art. A lacing system is attached to the lower shell 102. The lacing system is substantially similar to the lacing system of FIGS. 1*a*-*b*, except that the position of the various components, and the routing of the tension member 112, is altered. The routing of the tension member 112 is more evident in FIG. 2*b*, which is a simple representation of the lacing system and lower shell 102.

As illustrated, the reel based device 110 is positioned on the overlapping flap 118. Tensioning of the tension member 112 pulls the overlapping flap 118 over the underlying flap, which causes the reel based device 110 to move or slide laterally about the lower shell 102. The tension member 112 is routed from the reel based device 110 diagonally to a first guide 114*a* that is positioned longitudinally above the reel based device 110 (i.e., closer to the upper cuff 104) and across the seam 106. The tension member 112 is routed from the first guide 114*a* to a second guide 114*b* that is also positioned longitudinally above the reel based device 110 on the overlapping flap 118. The tension member 112 is routed from the second guide 114*b* to a third guide 114*c* that is positioned across the seam 106 from the reel based device 110. The tension member 112 crosses itself as it is routed between the first guide 114*a*, the second guide 114*b*, and the third guide 114*c*. The tension member is routed from the third guide 114*c* to a fourth guide 114*d* that is positioned longitudinally below the reel based device 110 on the overlapping flap 118. The tension member 112 is routed from the fourth guide 114*d* to a termination guide 116 that is positioned longitudinally below the reel based device 110 and across the seam 106 from the reel based device 110.

Similar to the lacing system of FIGS. 1*a-b*, the reel based device 110 is positioned near a midpoint or center of the lace path defined by the tension member 112 so that a guide set, or one or more guides, is positioned longitudinally above the reel based device 110 and one or more guides are positioned longitudinally below the reel based device 110. The tension member 112 includes a single crossing in the illustrated embodiment. As illustrated in FIG. 2*a*, the distal end of the second guide 114*b* and the distal end of the fourth guide 114*d* extend to the seam 106 or across the seam 106. The second guide 114*b* and the fourth guide 114*d* are longer guides while the first guide 114*a*, third guide 114*c*, and termination guide 116 are shorter guides.

Figure 3A:
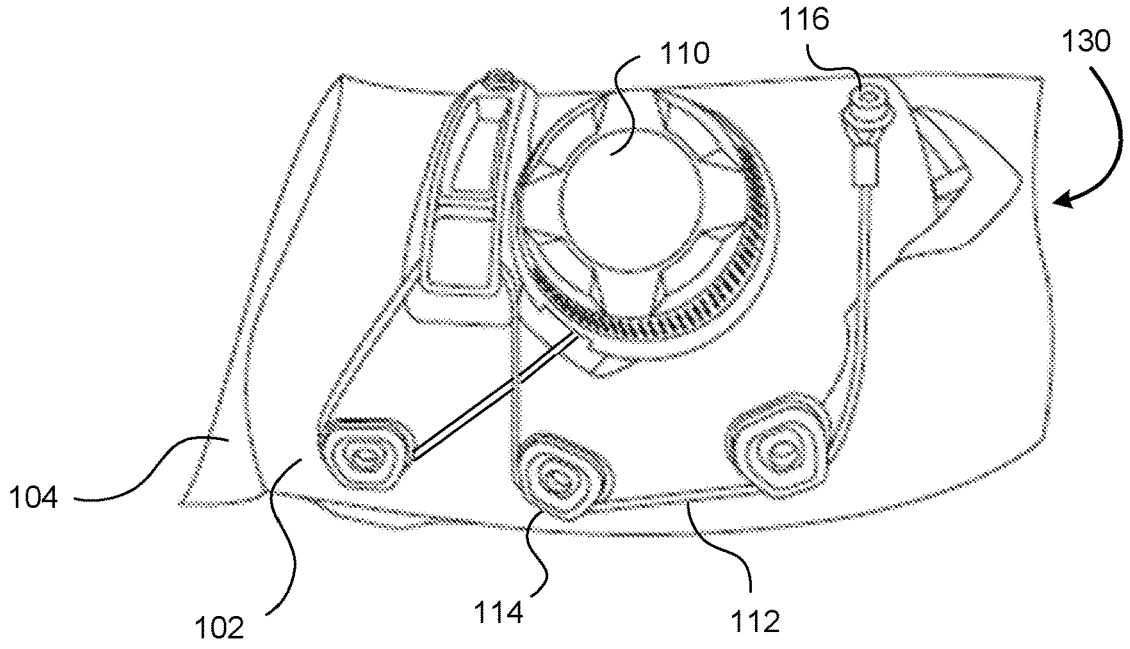
FIGS. 3*a-b* illustrate a third configuration of a lacing system for a ski boot.
Figure 3B:
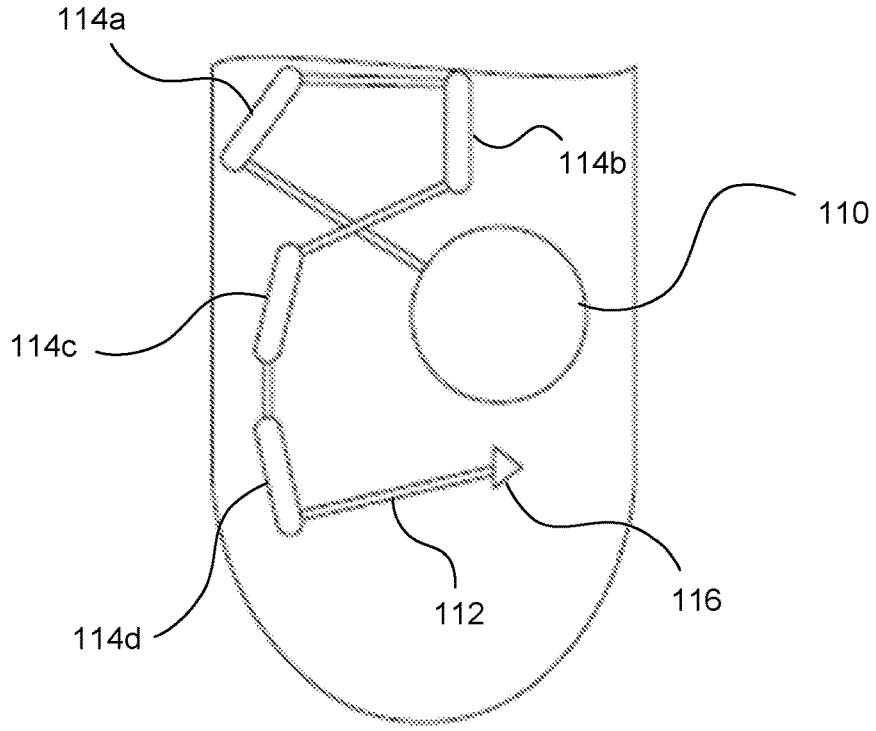

Referring to FIGS. 3*a-b*, illustrated is another ski boot 130 that includes a lower shell 102 and upper cuff 104 that is coupled with the lower shell as is known in the art. A lacing system is attached to the lower shell 102, which is similar to the lacing system of FIGS. 1*a-b* and/or FIGS. 2*a-b*, except that the position of the guides 114, and the routing of the tension member 112, is altered. The routing of the tension member 112 is more evident in FIG. 3*b*, which is a simple representation of the lacing system and lower shell 102.

The reel based device 110 may be positioned on the overlapping flap 118 or on the opposing flap as illustrated in the prior embodiments. However, as with the prior embodiments, tensioning of the tension member 112 pulls the overlapping flap 118 over the underlying flap, which causes the lower shell 102 to constrict about the wearer's foot and ankle. The tension member 112 is routed from the reel based device 110 diagonally to a first guide 114*a* that is positioned longitudinally above the reel based device 110 (i.e., closer to the upper cuff 104) and across the seam 106 from the reel based device 110. The tension member 112 is routed from the first guide 114*a* to a second guide 114*b* that is also positioned longitudinally above the reel based device 110 on the same side as the reel based device 110. The tension member 112 is routed from the second guide 114*b* to a third guide 114*c* that is positioned across the seam 106 from the reel based device 110. The tension member 112 crosses itself as it is routed between the first guide 114*a*, the second guide 114*b*, and the third guide 114*c*. The tension member is routed from the third guide 114*c* to a fourth guide 114*d* that is positioned longitudinally below the reel based device 110. Unlike the prior embodiments, the fourth guide 114*d* is positioned on an opposite side of the seam 106 from the reel based device 110. As such, the path of the tension member 112 between the third guide 114*c* and the fourth guide 114*d* roughly parallels a direction of the seam 106. The tension member 112 is routed from the fourth guide 114*d* to a termination guide 116 that is positioned longitudinally below the reel based device 110 on the same side of the seam 106 as the reel based device 110.

Similar to the lacing systems of FIGS. 1*a-b* and FIGS. 2*a-b*, the reel based device 110 is positioned near a midpoint or center of the lace path defined by the tension member 112 so that a guide set, or one or more guides, is positioned longitudinally above the reel based device 110 and one or more guides are positioned longitudinally below the reel based device 110. As illustrated in FIG. 3*a*, the tension member 112 includes a single crossing and distal end of the second guide 114*b* extends to the seam 106 or across the seam 106. The second guide 114*b* may be a longer guide while the first guide 114*a*, third guide 114*c*, fourth guide 114*d*, and termination guide 116 are shorter guides.

Figure 4A:
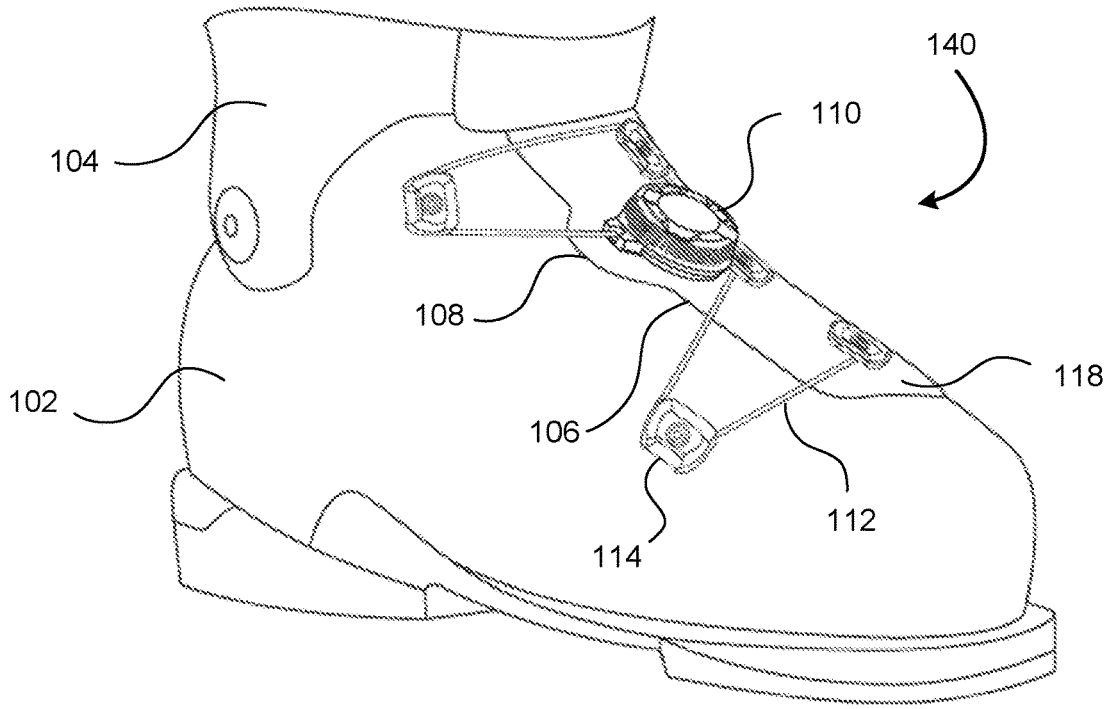
FIGS. 4*a-b* illustrate a fourth configuration of a lacing system for a ski boot.
Figure 4B:
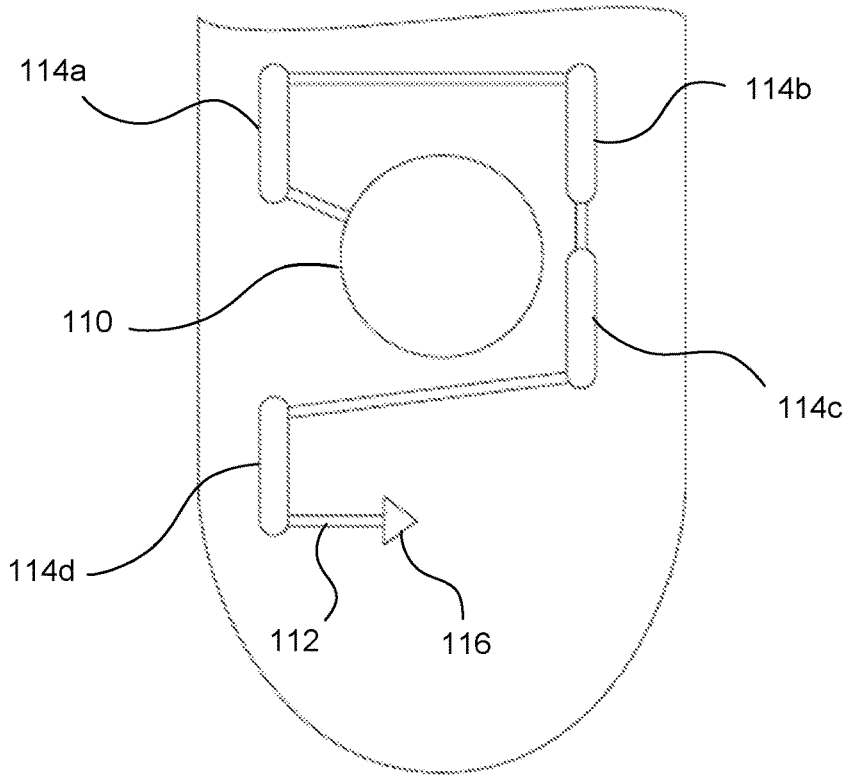

Referring to FIGS. 4*a-b*, illustrated is another ski boot 140 that includes a lower shell 102 and upper cuff 104 that is coupled with the lower shell as is known in the art. A lacing system is attached to the lower shell 102, which is similar to the lacing system of FIGS. 1*a-b*, 2*a-b*, and/or 3*a-b*, except that the position of the guides 114, and the routing of the tension member 112, is altered. The routing of the tension member 112 is more evident in FIG. 4*b*, which is a simple representation of the lacing system and lower shell 102.

The reel based device 110 is positioned on the overlapping flap 118. As such, tensioning of the tension member 112 pulls the overlapping flap 118 over the underlying flap, which causes the reel based device 110 to slide or move laterally relative to the ski boot 100. The tension member 112 is routed from the reel based device 110 diagonally to a first guide 114*a* that is positioned longitudinally above the reel based device 110 (i.e., closer to the upper cuff 104) and across the seam 106 from the reel based device 110. The tension member 112 is routed from the first guide 114*a* to a second guide 114*b* that is also positioned longitudinally above the reel based device 110 on the same side of the lower shell 102 as the reel based device 110. The tension member 112 is routed from the second guide 114*b* to a third guide 114*c* that is also positioned on the same side of the lower shell 102 as the reel based device 110. Because the second guide 114*b* and third guide 114*c* are positioned on the same side of the lower shell 102 as the reel based device 110, the path of the tension member 112 between the second guide 114*b* and the third guide 114*c* roughly parallels the direction of the seam 106. In addition, in contrast to the prior embodiments, the tension member 112 does not cross itself as it is routed between the first guide 114*a*, the second guide 114*b*, and the third guide 114*c*. Rather, in the illustrated embodiment, the tension member 112 does not cross itself along the entire lace path, although in some instances the tension member may cross itself near the forefront of the lower shell 102.

The tension member 112 is routed from the third guide 114*c* to a fourth guide 114*d* that is positioned longitudinally below the reel based device 110 and on the opposite side of the seam 106 from the reel based device 110. The tension member 112 is routed from the fourth guide 114*d* to a termination guide 116 that is positioned longitudinally below the reel based device 110, typically on the same side of the seam 106 as the reel based device 110. Unlike the prior embodiments, the overlapping flap 118 is not linear edge. Rather, an extension or tab 108 is formed in the edge of the overlapping flap 118 near the reel based device 110. The extension or tab 108 may be specifically designed to accommodate the reel based device 110, such as by reinforcing a lace port or exit, contacting the tension member 112, and the like. The extension or tab 108 may have a constant radius or curvature so that it forms or defines a semi-circle that extends from the edge of the overlapping flap 118.

Similar to the lacing systems of the prior embodiments, the reel based device 110 is positioned near a midpoint or center of the lace path defined by the tension member 112 so that a guide set, or one or more guides, is positioned longitudinally above the reel based device 110 and one or more guides are positioned longitudinally below the reel based device 110. This positioning of the reel based device 110 and guides 114 effects a greater tightening of the ankle as described herein. FIGS. 4*a-b* illustrate each of the guides as being shorter guides, although in some instances, one or more of the guides may be longer guides and/or a distal end of one or more guides may extend to near the seam 106 or across the seam 106 as desired.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A ski boot comprising:

an upper cuff;

a lower shell coupled with the upper cuff;

a reel based closure device coupled with the lower shell;

a tension member operably coupled with the reel based closure device so that an operation of the reel based closure device adjusts a tension of the tension member; and at least one guide member coupled with the lower shell and operably coupled with the tension member to route or direct the tension member along a lace path about the lower shell; wherein:

the lace path includes an upper end positioned near the upper cuff, a lower end positioned near a toe region of the ski boot, and a midpoint positioned between the upper end and lower end; and the reel based closure device is positioned near the midpoint of the lace path so that a first portion of the tension member is routed above the reel based closure device on the upper end of the lace path and a second portion of the tension member is routed below the reel based closure device on the lower end of the lace path;

the lower shell includes a first flap or panel and a second flap or panel that overlaps the first flap or panel to form a seam;

the reel based closure device is positioned on the first flap or panel or the second flap or panel;

the lace path crosses the seam one or more times;

the reel based closure device is coupled with the first flap or panel;

the at least one guide member includes a first guide member and a second guide member coupled with the first flap or panel;

the first guide member is positioned on the upper end of the lace path above the reel based closure device;

the second guide member is positioned on the lower end of the lace path below the reel based closure device; and the first guide member and the second guide member are the only guide members coupled with the first flap or panel.

2. The ski boot of claim 1, wherein a proximal end of the tension member is coupled with the reel based closure device so that the reel based closure device only tensions a single end of the tension member.

3. The ski boot of claim 1, wherein the tension member is routed directly from the reel based closure device to a pair of guide members that are positioned on an upper most end of the lace path.

4. The ski boot of claim 3, wherein the tension member only crosses itself once along the lace path.

5. The ski boot of claim 1, wherein the reel based closure device is configured to enable an incremental release in tension of the tension member and a full release of tension in the tension member.

6. A ski boot comprising:

an outer shell;

a reel based closure device coupled with the outer shell;

a tension member operably coupled with the reel based closure device so that an operation of the reel based closure device adjusts a tension of the tension member; and at least one guide member coupled with the outer shell and operably coupled with the tension member to route or direct the tension member along a lace path about the outer shell;

wherein the lace path includes an upper end, a lower end, and a midpoint positioned between the upper end and lower end; and wherein the reel based closure device is positioned near the midpoint of the lace path;

wherein the tension member is routed directly from the reel based closure device to a pair of guide members that are positioned on an upper most end of the lace path; and wherein the tension member only crosses itself once along the lace path.

7. The ski boot of claim 6, wherein the outer shell includes a first flap or panel and a second flap or panel that overlaps the first flap or panel to form a seam, wherein the reel based closure device is positioned on the first flap or panel or the second flap or panel, and wherein the lace path crosses the seam one or more times.

8. The ski boot of claim 7, wherein the at least one guide member includes a first guide member and a second guide member that are coupled with the second flap or panel, wherein a distal end of the first guide member extends laterally across the second flap or panel to the seam and a distal end of the second guide member extends laterally across the second flap or panel across the seam.

9. The ski boot of claim 7, wherein:

the reel based closure device is coupled with the first flap or panel;

the at least one guide member includes a first guide member and a second guide member coupled with the first flap or panel;

the first guide member is positioned on the upper end of the lace path above the reel based closure device;

the second guide member is positioned on the lower end of the lace path below the reel based closure device; and the first guide member and the second guide member are the only guide members coupled with the first flap or panel.

10. The ski boot of claim 6, wherein a proximal end of the tension member is coupled with the reel based closure device so that the reel based closure device tensions a single end of the tension member.

11. An article of footwear comprising:

an outer material that defines an outer layer of the article of footwear;

a reel based closure device coupled with the outer material;

a tension member operably coupled with the reel based closure device so that an operation of the reel based closure device adjusts a tension of the tension member; and at least one guide member coupled with the outer material and operably coupled with the tension member to route or direct the tension member along a lace path about the article of footwear;

wherein the lace path includes an upper end, a lower end, and a midpoint positioned between the upper end and lower end; and wherein the reel based closure device is positioned near the midpoint of the lace path;

wherein the tension member is routed directly from the reel based closure device to a pair of guide members that are positioned on an upper most end of the lace path; and wherein the tension member only crosses itself once along the lace path.

12. The article of footwear of claim 11, wherein a proximal end of the tension member is coupled with the reel based closure device so that the reel based closure device tensions a single end of the tension member.

13. A ski boot comprising:

an outer shell;

a reel based closure device coupled with the outer shell;

a tension member operably coupled with the reel based closure device so that an operation of the reel based closure device adjusts a tension of the tension member; and at least one guide member coupled with the outer shell and operably coupled with the tension member to route or direct the tension member along a lace path about the outer shell;

wherein:

the lace path includes an upper end, a lower end, and a midpoint positioned between the upper end and lower end; and the reel based closure device is positioned near the midpoint of the lace path;

the outer shell includes a first flap or panel and a second flap or panel that overlaps the first flap or panel to form a seam;

the reel based closure device is positioned on the first flap or panel or the second flap or panel;

the lace path crosses the seam one or more times;

the at least one guide member includes a first guide member and a second guide member that are coupled with the second flap or panel;

a distal end of the first guide member extends laterally across the second flap or panel to the seam; and a distal end of the second guide member extends laterally across the second flap or panel across the seam.

14. The ski boot of claim 13, wherein the tension member is routed directly from the reel based closure device to a pair of guide members that are positioned on an upper most end of the lace path.

15. The ski boot of claim 14, wherein the tension member only crosses itself once along the lace path.

16. The ski boot of claim 13, wherein:

the reel based closure device is coupled with the first flap or panel;

the at least one guide member includes a third guide member and a fourth guide member coupled with the first flap or panel;

the third guide member is positioned on the upper end of the lace path above the reel based closure device;

the fourth guide member is positioned on the lower end of the lace path below the reel based closure device; and the third guide member and the fourth guide member are the only guide members coupled with the first flap or panel.

17. The ski boot of claim 13, wherein a proximal end of the tension member is coupled with the reel based closure device so that the reel based closure device tensions a single end of the tension member.

* * * * *